United States Patent [19]

Kuznetsov et al.

[11] 4,231,860

[45] Nov. 4, 1980

[54] FLOTATION MACHINE

[76] Inventors: Vyacheslav D. Kuznetsov, ulitsa Akademika Pavlova, 140a, kv. 97; Boris P. Preobrazhensky, viezd Trinklera, 5, kv. 79; Valentin E. Rozhnov, ulitsa Tobolskaya, 52, kv. 10; Jury V. Stepanov, ploschad Rozy Ljuxemburg, 5, kv. 10, all of Kharkov; Anatoly N. Belitsky, ulitsa Deputatskaya, 166, kv. 55, Makeevka Donetskoi oblasti; Viktor N. Beizer, 763 kvartal dom 14, kv. 26, Makeevka Dontskoi oblasti; Grigory A. Tokar, bulvar 8 Sentyabrya, 6, kv. 28, Makeevka Donetskoi oblasti; Ivan K. Plastovets, bulvar 8 Sentyabrya, 14, kv. 1, Makeevka Donetskoi oblasti; Ivan I. Barylo, ulitsa Ostrovskogo, 10/32, kv. 5, Makeevka Donetskoi oblasti; Boris A. Koval, ulitsa Artema, 80a, kv. 86, Donetsk; Sergei F. Chepurnykh, ulitsa Matrosova, 14a, kv. 58, Kharkov; Petr N. Chumachenko, prospekt Traktorostroitelei 107, kv. 204, Kharkov; Nikolai F. Simonov, ulitsa Ivanova, 12/16, kv. 46, Kharkov; Petr P. Kharkhardin, prospekt Kirova, 109, kv. 48, Dnepropetrovsk; Ilya M. Litmanovich, ulitsa Suvorova, 8, kv. 4, Makeevka Donetskoi oblasti, all of U.S.S.R.

[21] Appl. No.: 944,129

[22] Filed: Sep. 20, 1978

[30] Foreign Application Priority Data

Sep. 21, 1977 [SU] U.S.S.R. ....., 2524485

[51] Int. Cl.[2] ..... B03D 1/18

[52] U.S. Cl. ..... 209/169; 261/87

[58] Field of Search ..... 209/168–170; 261/87, 93; 210/221 M

[56] References Cited

U.S. PATENT DOCUMENTS

| | | | |
|---|---|---|---|
| 2,609,097 | 9/1952 | Dering | 209/169 |
| 3,409,130 | 11/1968 | Nakamura | 261/93 X |

FOREIGN PATENT DOCUMENTS

| | | | |
|---|---|---|---|
| 2161721 | 6/1973 | Fed. Rep. of Germany | 209/169 |
| 400368 | 5/1971 | U.S.S.R. | 209/168 |

*Primary Examiner*—Ralph J. Hill

*Attorney, Agent, or Firm*—Lackenbach, Lilling & Siegel

[57] ABSTRACT

A flotation machine is intended to carry out flotation of valuable minerals, such as coal, for example, and comprises a plurality of cells provided with pulp receiving and discharging means. Mounted in each cell above horizontal stator plates and in spaced relationship therewith are aerators. Each stator horizontal plate is formed with a central opening disposed below each aerator. Arranged intermediate the stator plates is a means for regulating longitudinal recirculating streams of pulp, and between side walls of the cell and the stator plates there are arranged means for regulating transverse streams of pulp. Each of the horizontal stator plates is formed with vertical blades arranged all around the aerator at an angle to a vertical plane passing through the center of the aerator, this angle coinciding with the angle at which the pulp is discharged by the aerator. To prevent swirls in the pulp flow under the aerator, a cruciform partition is mounted below the stator plate. In the space below an overflow weir in the upper part of the cell there are provided baffle plates arranged symmetrically at an angle relative to the longitudinal axis of the cell. The baffle plates are positioned so as to permit the angle of their inclination to the horizontal to be readily adjusted.

11 Claims, 4 Drawing Figures

FLOTATION MACHINE

BACKGROUND OF THE INVENTION

1. Field of the Invention

The present invention relates to mineral dressing and, more particularly, to flotation machines.

The invention is readily applicable for use in ore-mining, coke- and coal-mining and other related industries.

Treatment of slimes, carried out on an ever growing scale, as well as the modern trend toward flotation of diluted pulps, requires the provision of flotation machines of large capacity (not less than 800 $m^3/h$).

Such a rate of operation is possible to achieve in large-capacity cells of 8 to 11 $m^3$, and even of 17 $m^3$. The employment of large-capacity cells enables their production efficiency to be enhanced, power consumption to be reduced, and capital and operating costs to be reduced ("Equipment for Flotation Machines", Report at All-Union Seminar on Science and Technology, Apr. 18–20, 1972, the city of Voroshilovgrad, pp. 33–34).

Large-capacity flotation machines, however, are not free from disadvantages, for example, such as nonuniform aeration of pulp throughout the cell volume, insufficient recirculation and slow speed of pulp streams, and delays in the removal of froth, particularly, from the central part of the cell.

2. Description of the Prior Art

For example, there is known a flotation machine (cf. USSR Inventor's Certificate No. 400,368, cl. B03 D I/24), in which two horizontal aerators are mounted on the outside with the purpose of increasing the pulp load capacity. In this machine, therefore, the aeration zone and the flotation zone are separated from one another.

When put in operation, the flotation machine of the Inventor's Certificate referred to above has not exhibited high production efficiency, but revealed low performance characteristics due to the minimum recirculation of pulp and the insufficient amount of sucked-in air. In the course of operation air is accumulated in the upper part of the cell, which is then periodically discharged in substantial portions and thus destroys the froth layer. USSR Inventor's Certificate No. 366,889 discloses a flotation machine which has two horizontal aerators compartmented by vertical partitions. This machine suffers basically from the same disadvantages as the previously described one. The pulp streams circulating in the cell are not efficient enough, the directional flow of pulp in the lower part of the cell is almost nonexistent. Therefore, the machine is not highly efficient and is complicated in construction.

There is also known a flotation machine (cf. "Modern Foreign-Made Flotation Machines", Moscow Publishers, 1971, pp. 9–25), which comprises a plurality of flotation cells arranged in series, each being provided with an inlet opening for feed to pass there-through and with outlet discharge compartments combined in units and arranged in stages. The units are connected by means of boxes intended to adjust the level of pulp in the compartments of separate units. Mounted in each compartment are four impellers with stabilizers. The stabilizers are made in the form of square-shaped plates each fitted with a central opening to receive the impeller. Fixed on the surface of the plate are radially arranged blades. The periphery of each opening in the plate passes over internal edges of the vertical blades. Intermediate external surfaces of the plate and the walls of each cell, as well as between adjacent plates, there are provided gaps adapted to ensure pulp circulation. The main disadvantage of this prior-art machine is that the streams of pulp are flown in disorderly manner in the cell provided with four impellers causing pulp swirls which result in froth breakage. With the impeller being arranged on the plate, radial streams are created thereon, which overlap the streams created by the impeller located nearby. In the space under the plate, however, the center-bound streams are nonexistant at all. In addition, the rate and direction of the recirculating flows are impossible to regulate in the above-described machine. All the disadvantages cited above render the prior-art flotation machine inefficient in operation.

U.S. Pat. No. 3,647,066 (or Federal Republic of Germany Pat. No. 1,533,570) describes a flotation machine which comprises a plurality of cells arranged in series and combined in units, each of which may accommodate two or four aerators set in strict symmetry relative to the walls of each cell. The machine also incorporates a froth-removing device, a feed compartment and a free-circulation compartment, discharging launders, and a stator means made in the form of a square plate with an opening for an aerator. Arranged on the plate around the aerator are stator plates.

The disadvantage of the above-described machine is that there is substantial swirling of pulp created over the cell surface, which results in the froth being demineralized. The reason for this is that with two impellers being arranged in one cell transversely to the pulp flow, or with four impellers disposed transversely and longitudinally to the pulp flow, the streams of the rejected liquid from two different impellers tend to overlap. This being the case (V. G. Geiff ed al. "Hydraulics and Hydraulic Drive", "Nedra", Moscow Publishers, 1970, pp. 118–121), a combined flow is created which is bound toward the bottom of the cell and toward the froth layer. This, in turn, brings about froth breakage.

Another disadvantage of this machine is insufficient and uncontrolled recirculation of pulp.

It is known (cf. "issledovanie Protsessa Aeratsii V Mekhanicheskikh Flotatsionnykh Machinakh"/"A Study of Aeration in Mechanical Flotation Machines", "Gorniy Journal" No. 2, 1969, pp. 151–161 that the rate of pulp circulation has direct bearing on the flotation process. The higher the feed rate of pulp, the higher is the rate of its circulation. To ensure good conditions for carrying out the flotation process with changes in the feed rate and in the content of solids, the rate of circulation should be regulated within a broad range. The direction and rate of circulation should be predetermined. In the machine disclosed in U.S. Pat. No. 3,647,066 these variables are impossible to control, and, therefore, the direction of pulp streams in the cell is chaotic.

In addition, the above-mentioned machine has a disadvantage which resides in the impossibility of timely removing the froth accumulated in the central part of the cell. The machine is designed so that the removal of froth from the central part of the cell is carried out with the aid of a trough positioned along the longitudinal axis of the machine.

When four impellers are arranged in the cell, the extent of froth removal in the interspace between the impellers is poor, which results in froth buildup in this zone. Moreover, there is no removal of froth from the area disposed between the path, along which pass the pulp streams, and the shafts of the impellers.

From the above it follows that the prior-art flotation machines described above fail to provide effective flotation of large amounts of pulp.

SUMMARY OF THE INVENTION

It is therefore an object of the present invention to enhance production efficiency of a flotation machine.

Another object of the invention is to ensure effective flotation of large amounts of pulp.

Still another object of the invention is to improve the ash content of the flotation products (that of the concentrate and tailings).

And, it is an object of the invention to ensure effective removal of froth throughout the surface of pulp in a cell of a flotation machine.

These and other objects of the invention are accomplished by a flotation machine comprising a plurality of cells arranged in series and accommodating pulp receiving and discharging devices, aerators with horizontal stator plates, each fitted with a central opening and vertical blades, arranged around each of the aerators; and a froth-removing means. According to the invention, the aerators are mounted in each cell in spaced relationship with the stator plates above the central openings thereof. Arranged intermediate the stator plates in the pulp flow direction is a means for regulating the longitudinal recirculating flow of pulp. Between side walls of the cell and the stator plates there are arranged means for regulating transverse streams of pulp.

This invention makes it possible to substantially increase the production efficiency of a flotation machine and to increase the flotation process as a whole. The provision of the means for regulating the circulation of pulp flows makes it possible, depending on the grain-size of the feed, its density and the pulp amount fed to the machine, to vary the feed rate and alter the direction of pulp flow, as well as to regulate the rate of circulation.

By causing the pulp streams to flow in a predetermined direction, it becomes possible to materially improve the grade of the products of flotation (the concentrate and tailings).

According to one embodiment of the invention, each pulp flow regulating means is made in the form of a gate.

The blades of the stator plates are preferably arranged at an angle to a vertical plane passing through the center of the aerator, the angle coinciding with the angle at which the pulp is discharged by the aerator.

Such an arrangement of the blades permits their service life to be substantially increased, prevents the swirling of pulp in the cell, and improves air distribution in the cell. The length of the blades is selected such that it would be possible to extend the path of upward flows of pulp as far as the side walls of the cell, thereby precluding the formation of dead zones at the surface of the stationary plate.

The blades of the stationary plate are preferably arranged at an angle of 57 to 63 deg. to a vertical plane passing through the center of the aerator.

According to one embodiment of the invention, a cruciform partition is placed under each stator plate coaxially with its central opening and in spaced relationship with the bottom of the cell. The provision of this partition permits the eddy flows of pulp, created in the space under the stator plate during rotation of the aerator, to be straightened out.

In addition, the relative speed of rotation of the aerator, as well as of the pulp moving therearound, is increased to thereby enable large-size particles of a valuable mineral, such as coal, to be raised from the lower part of the cell to the zone of active agitation.

Thus, the use of the cruciform partition makes it possible to carry out flotation of large-size particles of coal, which precludes the accumulation of such particles in the corners of the cell.

According to another embodiment of the invention, baffle plates are uniformly arranged across the cell in the upper part thereof below its over-flow weir, said baffle plates being set symmetrically at an angle relative to the longitudinal axis of the cell so as to permit the angle of their inclination to the horizontal to be readily adjusted.

Such an arrangement of the baffle plates prevents froth accumulation at the pulp surface and makes it possible to control the speed of the froth on the way to the froth-removing means, depending on the content of solids in the pulp, as well as on the extent of loading (i.e. the flow rate of pulp in the machine).

It has been found that the best performance of the machine is achieved with the baffle plates being arranged at an angle of 25 to 35 deg. to the longitudinal axis of the cell.

According to one possible embodiment of the invention, a T-shaped partition is mounted in the last cell (the last viewed in the direction of the pulp flow before the discharging device).

The provision of the partition of the type described above prevents the aerated pulp from passing into a discharging device or a free-circulation compartment, thereby improving performance characteristics of the machine.

BRIEF DESCRIPTION OF THE DRAWINGS

The invention will be further described, by way of example only, with reference to the accompanying drawings, wherein.

DETAILED DESCRIPTION OF THE PREFERRED EMBODIMENT

Figure 1:
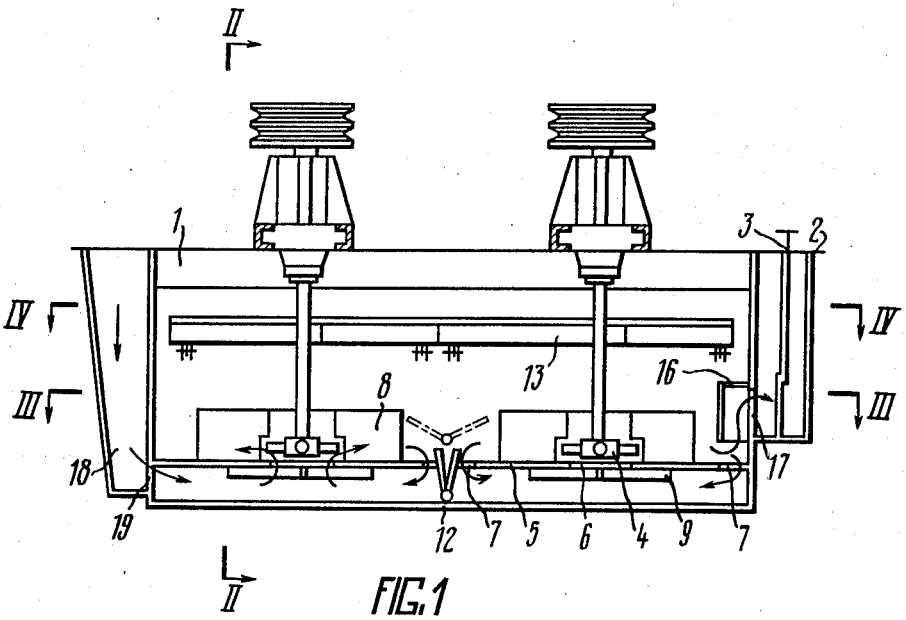
FIG. 1 is a longitudinal sectional view of a flotation machine according to the invention.
Figure 3:
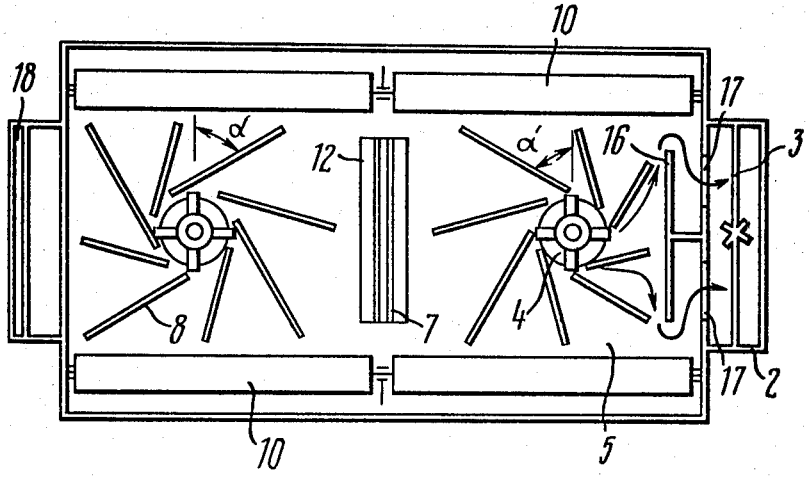
FIG. 3 is a cross-sectional view taken along the line III—III of FIG. 1.

Referring now to the drawings, and to FIG. 1 in particular, there is shown therein a flotation machine which comprises a plurality of cells 1 arranged in series, each having its cross-sectional area smoothly increasing from the bottom upwards. The cells 1 are interconnected by discharging means or free-circulation compartments 2 provided with slides 3. Aerators 4 are arranged in one row along the longitudinal axis of the cell 1, two aerators in each cell 1. Each of the aerators 4 mounted in the cell 1 is offset relative to the transverse axis of the cell 1 towards its end walls, such as shown in FIG. 3, and set in spaced relationship with a stator plate 5 above its central opening 6.

Provided between the stator plates 5 of the adjacent aerators 4 along the pulp flow is a gap 7.

Mounted on each stator plate 5 at an angle of 57 to 63 deg. to a vertical plane passing through the center line of the aerator 4 are blades 8. Fixed under the plate 5 is a cruciform partition 9 disposed in spaced relationship with the bottom of the cell 1. The blades 8 are therefore arranged so as to enable the angle at which pulp is discharged by the aerator 4 to coincide with the angle at which the blades 8 are set. The length of the blades 8 is selected such as to permit the path of the outgoing flows of pulp to extend as far as the side walls of the cell 1, thereby preventing the formation of dead zones across the cell 1 at the level of the stationary plate 5.

Mounted in interspaces 10 between the stator plates 5 and the side walls of the cell 1 are means 11 for regulating transverse flows of circulating pulp; positioned in the gap 7 between the plates 5 is a means 12 intended for regulating longitudinal flows of pulp and enabling the rate and direction of the pulp flow to be varied. Each of the pulp flow regulating means 11 and 12 can be made in the form of a gate. No means for regulating longitudinal pulp flows are provided between the plate 5 and the end wall of the cell 1, since all the large-size particles of coal, which have passed through the cell 1 unfloated, should return to the aeration zone under the plate 5.

Figure 2:
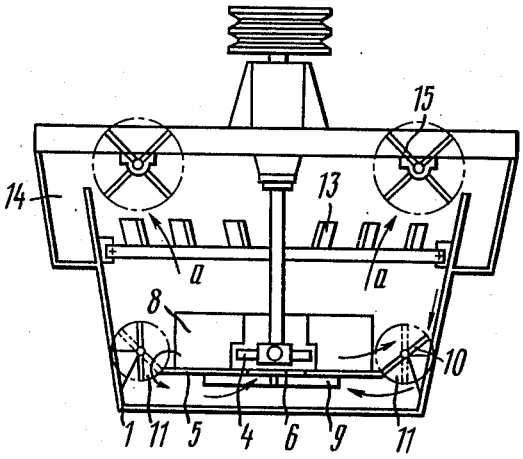
FIG. 2 is a cross-sectional view taken along the line II—II of FIG. 1.
Figure 4:
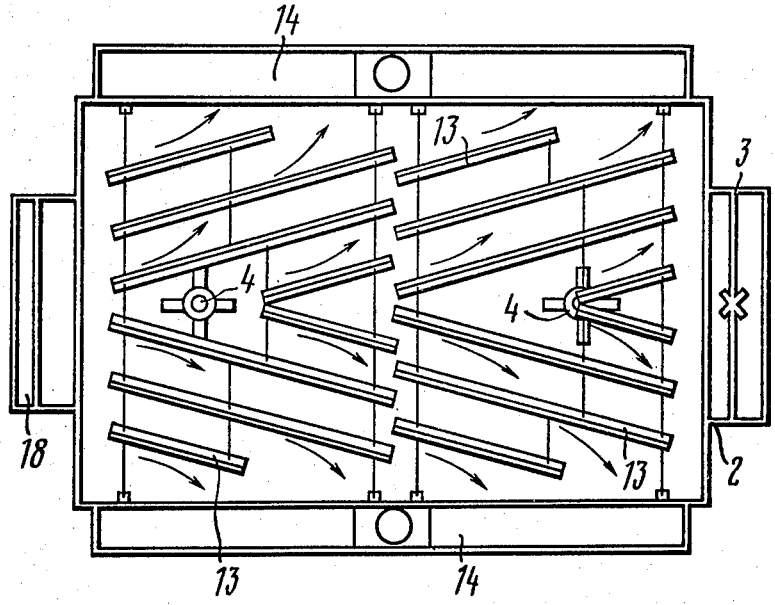
FIG. 4 is a cross-sectional view taken along the line IV—IV of FIG. 1.

Mounted above the stator plate 5 in the upper part of the cell 1 below its overflow weir are baffle plates 13 adapted to prevent eddy flows and provided with an adjustable angle of attack in the vertical direction and arranged uniformly across the cell 1. Each baffle plate 13 is set at an angle of 25 to 35 deg. to the longitudinal axis of the cell 1. Thus, each of the plates 13 is inclined at a definite angle towards the flow direction of the longitudinal pulp stream (see arrows in FIG. 4) along the machine, as well as relative to the direction in which the concentrate is discharged. The angle of inclination of the baffle plates 13 is varied with the change in the content of solids in the pulp and with the change in the feed rate. The baffle plates 13 are also used to change the direction of upward flows (see arrows "a" in FIG. 2) of the aerated pulp, causing the pulp to move in the direction of launders 14 of the discharge device. Such an arrangement of the baffle plates 13 prevents froth accumulation throughout the pulp surface and enables the froth to be transported at a higher speed towards the froth-removing means 15.

Positioned at the outlet of each cell 1 is a confining T-shaped partition 16 which is closed at the top and open at the side of the froth-removing devices 15 and of the bottom at the cell 1, as well as outlet ports 17 disposed in the end wall of the cell 1. The flotation machine of the invention is also provided with a receiving compartment 18 connected with the cell 1 through a port 19 (FIG. 1).

The flotation machine according to the invention operates in the following manner. Pulp is delivered to the receiving compartment 18 from which it flows underneath the stator plate 5 to be thereafter sucked in through the opening 6 by the aerator 4. The pulp is then aerated to the walls of the cell 1. While passing through the opening 6, the eddy flows of pulp are straightened out by means of the cruciform partition 9 and are then discharged into the cell 1. The cruciform partition 9 serves to enable the rise of large-size particles of coal to a froth layer and thus prevents their settling out underneath the stator plate 5. The aerated pulp is unhinderedly discharged at a great speed along the blades 8 and, on finding itself between the two adjacent blades 8, it loses its speed. The design and arrangement of the blades 8 according to the invention make it possible to lower resistance to the incoming pulp flow and prevent pulp swirl around the aerator 4, as well as to improve transport of large-size particles of coal. The portion of the pulp flow which has reached the side walls of the cell 1 without having sufficient airlift capacity is returned to the underside of the stator plate 5 through the adjustable gaps 10.

Depending on the grain-size and density of the feed, as well as on the pulp amount fed to the machine, the regulating means 11 are operable to change the speed and direction of the pulp flow to produce a recirculating flow of any volume and direction. For example, when a great amount of large-size particles of coal are contained in the feed, the regulating means 11 is positioned so as to enable the greatest amount of these particles entrained in the recirculating flow to return through the gap 10 under the stationary plate 5. The particles, which have risen to the froth layer and then have been severed therefrom under the action of the froth-removing means 15, descend along the wall of the cell 1 and also pass through the gap 10 to find themselves underneath the plate 5. In other words, recirculation of pulp is carried out in a manner described above.

The aerated streams of pulp flowing in an upward direction below the froth layer change their direction towards the launders 14 for concentration under the action of baffle plates 13. The angle of inclination of the baffle plates 13 is changed depending on the extent of loading, solid content, as well as on the number of cells 1. For example, when lowering the solid content in the pulp, lengthwise of the cell, the angle of inclination of the baffle plates 13 is decreased.

If the pulp stream flows along the cell, large particles of unfloated coal are accumulated in the lower part of the cell (on the stator plate 5); particles from getting to the tailings, as well as to reinforce recirculation of the longitudinal flow of pulp, a part of the pulp is removed by changing the size of the gap 7 with the aid of the regulating means 12. In addition, the regulating means 12 is used to preclude overlapping of the pulp streams swept away by the aerators 4. Due to the fact that these aerators 4, mounted in each of the cells 1, are offset with respect to the side walls thereof, thus increasing the area of the rising mineralized bubbles, the pulp streams bumping into the walls are almost damped without being able to reach the center of the cell 1, and the regulating means 12 is used to change their direction toward the froth layer.

At the outlet of the cell 1, the pulp, discharged by the aerator 4, flows as far as the partition 16, where it changes its direction toward the launders 14 and passes into the free-circulation compartment 2 through the ports 17. The ports 17 together with the partition 16 prevent the flow of pulp from passing to the free-circulation compartment 2, thus improving the performance characteristics of the flotation process.

Therefore, it has become possible to increase the production efficiency of the flotation machine according to the invention by up to 1000 $m^3/h$.

What is claimed is:

1. A flotation machine comprising a plurality of cells arranged in series and provided with pulp receiving and discharging devices, wherein each cell comprises: at least two aerators positioned within said cell along a longitudinal axis of said cell and offset toward a respective end wall from a transverse axis of said cell; at least two stator plates fitted with a central opening, each aerator being mounted in spaced relationship with a respective stator plate and above said central opening of said respective stator plate; vertical blades mounted on each stator plate at an angle to a vertical plane passing through a center point of a respective aerator; first regulating means positioned intermediate a gap defined between said stator plates along the flow direction of said pulp for regulating longitudinal recirculating flows of said pulp; second regulating means positioned between side walls of said cell and said stator plates for regulating transverse flows of said pulp; and froth-removing means positioned above said stator plates in an upper part of said cell.

2. A flotation machine as set forth in claim 1, wherein each of the regulating means comprises a gate.

3. A flotation machine as set forth in claim 1, wherein said vertical blades are arranged at an angle coinciding with the angle at which the pulp is discharged by the aerator.

4. A flotation machine as set forth in claim 3, wherein said vertical blades are arranged at an angle of 57 to 63 degrees to said vertical plane passing through the center point of the aerator.

5. A flotation machine comprising a plurality of cells arranged in series and provided with pulp receiving and discharging devices, wherein each cell comprises: at least two aerators positioned within said cell along a longitudinal axis of said cell and offset toward a respective end wall from a transverse axis of said cell; at least two stator plates fitted with a central opening, each aerator being mounted in spaced relationship with a respective stator plate and above said central opening of said respective stator plate; at least two cruciform partitions positioned in spaced relationship with a bottom of said cell, each cruciform partition being mounted under a respective stator plate and in coaxial alignment with said central opening of said respective stator plate; vertical blades mounted on each stator plate at an angle to a vertical plane passing through a center point of a respective aerator; first regulating means positioned intermediate a gap defined between said stator plates along the flow direction of said pulp for regulating longitudinal recirculating flows of said pulp; second regulating means positioned between side walls of said cell and said stator plates for regulating transverse flows of said pulp; and froth-removing means positioned above said stator plates in an upper part of said cell.

6. A flotation machine comprising a plurality of cells arranged in series and provided with pulp receiving and discharging devices, wherein each cell comprises: at least two aerators positioned within said cell along a longitudinal axis of said cell and offset toward a respective end wall from a transverse axis of said cell; at least two stator plates fitted with a central opening, each aerator being mounted in spaced relationship with a respective stator plate and above said central opening of said respective stator plate; vertical blades mounted on each stator plate at an angle to a vertical plane passing through a center point of a respective aerator; first regulating means positioned intermediate a gap defined between said stator plates along the flow direction of said pulp for regulating longitudinal recirculating flows of said pulp; second regulating means positioned between side walls of said cell and said stator plates for regulating transverse flows of said pulp; froth-removing means positioned above said stator plates in an upper part of said cell; and baffle plates uniformly arranged across said upper part of said cell below an overflow weir of said cell, said baffle plates being positioned symmetrically at an angle relative to said longitudinal axis of the cell, and the angle of inclination of each of said baffle plates being adjustable.

7. A flotation machine as set forth in claim 6, wherein said baffle plates are arranged at an angle of 25 to 35 degrees with respect to the longitudinal axis of the cell.

8. A flotation machine comprising a plurality of cells arranged in series and provided with pulp receiving and discharging devices, wherein each cell comprises: at least two aerators positioned within said cell along a longitudinal axis of said cell and offset toward a respective end wall from a transverse axis of said cell; at least two stator plates fitted with a central opening, each aerator being mounted in spaced relationship with a respective stator plate and above said central opening of said respective stator plate; vertical blades mounted on each stator plate at an angle to a vertical plane passing through a center point of a respective aerator; first regulating means positioned intermediate a gap defined between said stator plates along the flow direction of said pulp for regulating longitudinal recirculating flows of said pulp; second regulating means positioned between side walls of said cell and said stator plates for regulating transverse flows of said pulp; froth-removing means positioned above said stator plates in an upper part of said cell; and a T-shaped partition positioned at an outlet of said cell.

9. A flotation machine according to either of claims 5, 6 or 8, wherein each of said regulating means comprises a gate.

10. A flotation machine according to either of claims 5, 6 or 8, wherein said vertical blades are arranged at an angle coinciding with the angle at which the pulp is discharged by the aerator.

11. A flotation machine according to either of claims 5, 6 or 8, wherein said vertical blades are arranged at an angle of 57 to 63 degrees to said vertical plane passing through the center point of the aerator.

* * * * *